US010438601B2

(12) United States Patent
Bruhn

(10) Patent No.: US 10,438,601 B2
(45) Date of Patent: *Oct. 8, 2019

(54) METHOD AND ARRANGEMENT FOR CONTROLLING SMOOTHING OF STATIONARY BACKGROUND NOISE

(71) Applicant: TELEFONAKTIEBOLAGET L M ERICSSON (PUBL), Stockholm (SE)

(72) Inventor: Stefan Bruhn, Sollentuna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/817,218

(22) Filed: Nov. 19, 2017

(65) Prior Publication Data

US 2018/0075854 A1 Mar. 15, 2018

Related U.S. Application Data

(63) Continuation of application No. 15/019,242, filed on Feb. 9, 2016, now Pat. No. 9,852,739, which is a (Continued)

(51) Int. Cl.
*G10L 19/087* (2013.01)
*G10L 19/26* (2013.01)

(Continued)

(52) U.S. Cl.
CPC ..... *G10L 19/087* (2013.01); *G10L 19/06* (2013.01); *G10L 19/26* (2013.01); *G10L 21/02* (2013.01);

(Continued)

(58) Field of Classification Search
CPC ..... G10L 19/87; G10L 2019/0016
See application file for complete search history.

(56) References Cited

U.S. PATENT DOCUMENTS 5,321,793 A * 6/1994 Drogo De Iacovo ..... G10L 19/0204 704/219

5,487,087 A 1/1996 McCree et al.

(Continued)

FOREIGN PATENT DOCUMENTS

EP 0 665 530 A1 8/1995
EP 1 688 920 A1 8/2006

(Continued)

OTHER PUBLICATIONS

Wei C. et al. Modified silence suppression algorithms and their performance tests. Circuits and Systems, 2005. 48th Midwest Symposium on Cinicinnati, Ohio Aug. 7-10, 2005, Piscataway, US, Aug. 7, 2005 (Aug. 7, 2005).

(Continued)

*Primary Examiner* — Douglas Godbold

(57) ABSTRACT

In a method for coding of information for enhancing a background noise representation, voice activity of an input speech signal is determined. A noisiness parameter is determined for an inactive speech signal, wherein the noisiness parameter is based on a ratio of prediction gains of two Linear Predictive Coder (LPC) prediction filters with different orders. The noisiness parameter is quantized, and the quantized noisiness parameter is encoded for transmission.

30 Claims, 7 Drawing Sheets

Related U.S. Application Data continuation of application No. 12/530,341, filed as application No. PCT/SE2008/050220 on Feb. 27, 2008, now Pat. No. 9,318,117.

(60) Provisional application No. 60/892,991, filed on Mar. 5, 2007.

(51) Int. Cl.

| | |
|---|---|
| ***G10L 21/02*** | (2013.01) |
| ***G10L 19/06*** | (2013.01) |
| ***G10L 21/0308*** | (2013.01) |
| ***G10L 25/84*** | (2013.01) |
| *G10L 19/012* | (2013.01) |
| *G10L 21/0216* | (2013.01) |

(52) U.S. Cl.

CPC ..... *G10L 21/0308* (2013.01); *G10L 25/84* (2013.01); *G10L 19/012* (2013.01); *G10L 2021/02168* (2013.01)

(56) References Cited

U.S. PATENT DOCUMENTS

| | | | | |
|---|---|---|---|---|
| 5,579,432 | A | 11/1996 | Wigren | |
| 5,632,004 | A | 5/1997 | Bergstrom | |
| 5,953,697 | A | 9/1999 | Lin et al. | |
| 6,240,386 | B1 | 5/2001 | Thyssen et al. | |
| 6,275,798 | B1 | 8/2001 | Johansson et al. | |
| 7,020,605 | B2 | 3/2006 | Gao | |
| 7,058,572 | B1 * | 6/2006 | Nemer | G10L 21/0208 704/226 |
| 7,124,079 | B1 | 10/2006 | Johansson et al. | |
| 7,369,990 | B2 * | 5/2008 | Nemer | G10L 21/0208 379/392.01 |
| 8,032,363 | B2 * | 10/2011 | Chen | G10L 19/26 704/201 |
| 8,041,562 | B2 * | 10/2011 | Thyssen | G10L 19/005 704/212 |
| 2002/0103643 | A1 | 8/2002 | Rotola-Pukkila | |
| 2006/0041426 | A1 | 2/2006 | Ojanpera | |
| 2006/0083385 | A1 | 4/2006 | Allamanche et al. | |
| 2006/0229869 | A1 * | 10/2006 | Nemer | G10L 21/0208 704/226 |
| 2008/0059161 | A1 * | 3/2008 | Khalil | G10L 19/012 704/226 |
| 2010/0174537 | A1 * | 7/2010 | Vos | G10L 19/12 704/219 |

FOREIGN PATENT DOCUMENTS

| | | | |
|---|---|---|---|
| EP | 1 096 476 | A2 | 5/2011 |
| JP | 2001-083996 | A | 3/2001 |
| JP | 2001-134287 | A | 5/2001 |
| JP | 2001-134296 | A | 5/2001 |
| JP | 2002-523806 | A | 7/2002 |
| JP | H10-83200 | A | 3/2008 |
| WO | WO99/30315 | A1 | 6/1999 |
| WO | WO 00/11659 | A1 | 3/2000 |

OTHER PUBLICATIONS

Niamut et al. RD Optimal Temporal Noise Shaping for Transform Audio Coding. Acoustics, Speech and Signal Processing, 2006. ICASSP 2006 Proceedings 2006 IEEE International Conference on Toulouse, France May 14-19, 2006, Piscataway, NJ, USA, IEEE, Piscataway, NJ, USA, May 14, 2006 (May 14, 2006).

Jian Zhang et al. Real-time implementation of a low delay low bit rate vocoder with a single ADAP-21020. Vehicular Technology Conference, 1995 IEEE 45th Chicago, IL, USA Jul. 25-28, 1995, New York, NY, USA, IEEE, US, vol. 2, Jul. 25, 1995 (Jul. 25, 1995).

Herre J. et al. Extending the MPEG-4 AAC Codec by Perceptual Noise Substitution. Preprints of Papers Presented at the AES Convention, XX, XX, Jan. 1, 1998 (Jan. 1, 1998).

Serizawa, et al. A silence compression algorithm for multi-rate/dual-bandwidth MPEG-4 CELP standard. Acoustics, Speech, and Signal Processing, 2000. ICASSP •oo. Proceedings. 2000 IEEE International Conference on.

Sung-Jea Ko et al: Theoretical analysis of Winsorizing smoothers and their applications to image processing, Acoustics, Speech, and Signal Processing, 1991. ICASSP-91., 1991 International Conference on acoustics, speech &signal processing. ;cassp, pp. 3001-3004 vol. 4, Apr. 14-17, 1991, whole document, especially the introduction and chapter II and IV.

Ehara, H et al: Noise post processing based on a stationary noise generator, Speech Coding, Z002, IEEE Workshop Proceedings., pp. 178-1S0, Oct. 6-9, 2002, chapter 2.3.

3GPP TS 26.092 V6.0.0 (Dec. 2004), Technical specification group services and system aspects; Mandatory speech codec speech processing functions; Adaptive multi-rate (AMR) speech codec; Comfort noise aspects (Release 6), retrieved from: http://www.3gpp.org/ftp/Specs/archive/26_series/Z6.09Z/Z6092-600.zip, chapter 5.

Tasaki et.al., Post noise smoother to improve low bit rate speech-coding performance, IEEE Workshop on speech coding, 1999.

* cited by examiner

METHOD AND ARRANGEMENT FOR CONTROLLING SMOOTHING OF STATIONARY BACKGROUND NOISE

RELATED APPLICATIONS

This application is a continuation of co-pending U.S. patent application Ser. No. 15/019,242 filed Feb. 9, 2016 which is a continuation of U.S. patent application Ser. No. 12/530,341 filed Sep. 8, 2009 and issued as U.S. Pat. No. 9,318,117 on Apr. 19, 2016, which was the National Stage of International Application No. PCT/SE2008/050220, filed Feb. 27, 2008, which claims the benefit of U.S. Provisional Application No. 60/892,991, filed Mar. 5, 2007, the disclosures of which are incorporated herein by reference in their entireties.

TECHNICAL FIELD

The present invention relates to speech coding in telecommunication systems in general, especially to methods and arrangements for controlling the smoothing of stationary background noise in such systems.

BACKGROUND

Speech coding is the process of obtaining a compact representation of voice signals for efficient transmission over band-limited wired and wireless channels and/or storage. Today, speech coders have become essential components in telecommunications and in the multimedia infrastructure. Commercial systems that rely on efficient speech coding include cellular communication, voice over internet protocol (VOIP), videoconferencing, electronic toys, archiving, and digital simultaneous voice and data (DSVD), as well as numerous PC-based games and multimedia applications.

Being a continuous-time signal, speech may be represented digitally through a process of sampling and quantization. Speech samples are typically quantized using either 16-bit or 8-bit quantization. Like many other signals, a speech signal contains a great deal of information that is either redundant (nonzero mutual information between successive samples in the signal) or perceptually irrelevant (information that is unperceivable by human listeners). Most telecommunication coders are lossy, meaning that the synthesized speech is perceptually similar to the original but may be physically dissimilar.

A speech coder converts a digitized speech signal into a coded representation, which is usually transmitted in frames. Correspondingly, a speech decoder receives coded frames and synthesizes reconstructed speech.

Many modern speech coders belong to a large class of speech coders known as LPC (Linear Predictive Coders). Examples of such coders are: the 3GPP FR, EFR, AMR and AMR-WB speech codecs, the 3GPP2 EVRC, SMV and EVRC-WB speech codecs, and various ITU-T codecs such as G.728, G723, G.729, etc.

These coders all utilize a synthesis filter concept in the signal generation process. The filter is used to model the short-time spectrum of the signal that is to be reproduced, whereas the input to the filter is assumed to handle all other signal variations.

A common feature of these synthesis filter models is that the signal to be reproduced is represented by parameters defining the filter. The term "linear predictive" refers to a class of methods often used for estimating the filter parameters. Thus, the signal to be reproduced is partially represented by a set of filter parameters and partly by the excitation signal driving the filter.

The gain of such a coding concept arises from the fact that both the filter and its driving excitation signal can be described efficiently with relatively few bits.

One particular class of LPC based codecs are based on the analysis-by-synthesis (AbS) principle. These codecs incorporate a local copy of the decoder in the encoder and find the driving excitation signal of the synthesis filter by selecting that excitation signal among a set of candidate excitation signals which maximizes the similarity of the synthesized output signal with the original speech signal.

The concept of utilizing such a liner predictive coding and particularly AbS coding has proven to work relatively well for speech signals, even at low bit rates of e.g. 4-12 kbps. However, when the user of a mobile telephone using such coding technique is silent and the input signal comprises the surrounding sounds, the presently known coders have difficulties coping with this situation, since they are optimized for speech signals. A listener on the other side may easily get annoyed when familiar background sounds cannot be recognized since they have been "mistreated" by the coder.

So-called swirling causes one of the most severe quality degradations in the reproduced background sounds. This is a phenomenon occurring in scenarios with relatively stationary background sounds, such as car noise and is caused by non-natural temporal fluctuations of the power and the spectrum of the decoded signal. These fluctuations in turn are caused by inadequate estimation and quantization of the synthesis filter coefficients and its excitation signal. Usually, swirling becomes less when the codec bit rate increases.

Swirling has previously been identified as a problem and numerous solutions to it have been proposed in the literature. U.S. Pat. No. 5,632,004 [1] discloses one proposed solutions is disclosed in. According to this patent, during speech inactivity the filter parameters are modified by means of low pass filtering or bandwidth expansion such that spectral variations of the synthesized background sound are reduced. This method was further refined in U.S. Pat. No. 5,579,432 [2] such that the described anti-swirling technique is only applied upon detected stationary of the background noise.

U.S. Pat. No. 5,487,087 [3] discloses a further method addressing the swirling problem.

This method makes use of a modified signal quantization scheme, which matches both the signal itself and its temporal variations. In particular, it is envisioned to use such a reduced-fluctuation quantizer for LPC filter parameters and signal gain parameters during periods of inactive speech.

Signal quality degradations caused by undesired power fluctuations of the synthesized signal are addressed by another set of methods. One of them is described in U.S. Pat. No. 6,275,798 [4] and is also a part of the AMR speech codec algorithm described in 3GPP TS 26.090 [5]. According to this disclosure, the gain of at least one component of the synthesized filter excitation signal, the fixed codebook contribution, is adaptively smoothed depending on the stationarity of the LPC short-term spectrum. This method is further explored in the disclosures of patent EP 1096476 [6] and patent application EP 1688920 [7] where the smoothing operation further involves a limitation of the gain to be used in the signal synthesis. A related method to be used in LPC vocoders is described in U.S. Pat. No. 5,953,697 [8]. According to this disclosure, the gain of the excitation signal of the synthesis filter is controlled such that the maximum amplitude of the synthesized speech just reaches the input speech waveform envelope.

Another class of methods addressing the swirling problem operates as a post processor after a speech decoder. Patent EP 0665530 [9] describes a method that during detected speech inactivity replaces a portion of the speech decoder output signal by a low-pass filtered white noise or comfort noise signal. Similar approaches are taken in various publications that disclose related methods replacing part of the speech decoder output signal with filtered noise.

Scalable or embedded coding, with reference to FIG. 1, is a coding paradigm in which the coding is done in layers. A base or core layer encodes the signal at a low bit rate, while additional layers, each on top of the other, provide some enhancement relative to the coding, which is achieved with all layers from the core up to the respective previous layer. Each layer adds some additional bit rate. The generated bit stream is embedded, meaning that the bit stream of lower-layer encoding is embedded into bit streams of higher layers. This property makes it possible anywhere in the transmission or in the receiver to drop the bits belonging to higher layers. Such stripped bit stream can still be decoded up to the layer which bits are retained.

The most used scalable speech compression algorithm today is the 64 kbps G.711 A/U-law logarithm PCM codec. The 8 kHz sampled G.711 codec coverts 12 bit or 13 bit linear PCM samples to 8 bit logarithmic samples. The ordered bit representation of the logarithmic samples allows for stealing the Least Significant Bits (LSBs) in a G.711 bit stream, making the G.711 coder practically SNR-scalable between 48, 56 and 64 kbps. This scalability property of the G.711 codec is used in the Circuit Switched Communication Networks for in-band control signaling purposes. A recent example of use of this G.711 scaling property is the 3GPP TFO protocol that enables Wideband Speech setup and transport over legacy 64 kbps PCM links. Eight kbps of the original 64 kbps G.711 stream is used initially to allow for a call setup of the wideband speech service without affecting the narrowband service quality considerably. After call setup the wideband speech will use 16 kbps of the 64 kbps G.711 stream. Other older speech coding standards supporting open-loop scalability are G.727 (embedded ADPCM) and to some extent G.722 (sub-band ADPCM).

A more recent advance in scalable speech coding technology is the MPEG-4 standard that provides scalability extensions for MPEG4-CELP. The MPE base layer may be enhanced by transmission of additional filter parameter information or additional innovation parameter information. The International Telecommunications Union-Standardization Sector, ITU-T has recently ended the standardization of a new scalable codec G.729.1, nicknamed s G.729.EV. The bit rate range of this scalable speech codec is from 8 kbps to 32 kbps. The major use case for this codec is to allow efficient sharing of a limited bandwidth resource in home or office gateways, e.g. shared xDSL 64/128 kbps uplink between several VOIP calls.

One recent trend in scalable speech coding is to provide higher layers with support for the coding of non-speech audio signals such as music. In such codecs the lower layers employ mere conventional speech coding, e.g. according to the analysis-by-synthesis paradigm of which CELP is a prominent example. As such coding is very suitable for speech only but not that much for non-speech audio signals such as music, the upper layers work according to a coding paradigm which is used in audio codecs. Here, typically the upper layer encoding works on the coding error of the lower-layer coding.

Another relevant method concerning speech codecs is the so-called spectral tilt compensation, which is done in the context of adaptive post filtering of decoded speech. The problem solved by this is to compensate for the spectral tilt introduced by short-term or formant post filters. Such techniques are a part of e.g. the AMR codec and the SMV codec and primarily target the performance of the codec during speech rather than its background noise performance. The SMV codec applies this tilt compensation in the weighted residual domain before synthesis filtering though not in response to an LPC analysis of the residual.

Common to any of the above-described techniques addressing the swirling problem is that it is essential to apply them such that they provide the best possible enhancement effect on the swirling without negatively affecting the quality of the speech reproduction. All these methods hence provide only benefits if there are proper rules implemented according to which they are activated or inactivated depending on the properties of the signal to be reconstructed. In the following state-of-the-art anti-swirling techniques are discussed under the particular aspect of how they are controlled.

One prior art publication [10] discloses a particular noise smoothing method and its specific control. The control is based on an estimate of the background noise ratio in the decoded signal which in turn steers certain gain factors in that specific smoothing method. It is worth highlighting that unlike other methods the activation of this smoothing method is not controlled in response of a VAD flag or e.g. some stationarity metric.

In contrast to the above described prior art, another publication [11] describes a smoothing operation in response to some stationary noise detector. No dedicated VAD is used and rather a hard decision is made depending on measurements of LPC parameters (LSF) and energy fluctuations as well as on pitch information. In order to mitigate problems with misclassifications of speech frames as stationary noise frames a hangover period is added to bursts of speech.

Another prior art disclosure [9] describes a control function of a background noise smoothing method which operates in response to a VAD flag. In order to prevent speech frames from being declared inactive a hangover period is added to signal bursts declared active speech during which the noise smoothing remains inactive. To ensure smooth transitions from periods with background noise smoothing deactivated to periods with smoothing activated, the smoothing is gradually activated up to some fixed maximum degree of smoothing operation. The power and spectral characteristics (degree of high pass filtering) of the noise signal replacing parts of the decoded speech signal is made adaptive to a background noise level estimate in the decoded speech signal. However, the degree of smoothing operation, i.e. amount by which the decoded speech signal is replaced with noise merely depends on the VAD decision and by no means on an analysis of the properties (such as stationarity or so) of the background noise.

The previously mentioned disclosure of [4] describes a parameter smoothing method for a decoder that allows for gradual (gain) parameter smoothing in response to a mix factor. The mix factor is indicative of the stationarity of the signal to be reconstructed and controls the parameter smoothing such that more smoothing is performed the larger the detected stationarity is.

The main problem with the smoothing operation control algorithm according to the above [10] is that it is specifically tailored to the particular noise smoother described therein. It is hence not obvious if (and how) it could be used in connection with any other noise smoothing method. The fact that no VAD is used causes the particular problem that the method even performs signal modifications during active speech parts, which potentially degrade the speech or at least affect the naturalness of its reproduction.

The main problem with the smoothing algorithms according to [11] and [9] is that the degree of background noise smoothing is not gradually dependent on the properties of the background noise that is to be approximated. Prior art [11] for instance makes use of a stationary noise frame detection depending on which the smoothing operation is fully enabled or disabled. Similarly, the method disclosed in [9] does not have the ability to steer the smoothing method such that it is used to a lesser degree, depending on the background noise characteristics. This means that the methods may suffer from unnatural noise reproductions for those background noise types, which are classified as stationary noise or as inactive speech, though exhibit properties that cannot adequately be modeled by the employed noise smoothing method.

The main problem of the method disclosed in [4] is that it strongly relies on a stationarity estimate that takes into account at least a current parameter of the current frame and a corresponding previous parameter. During investigations related to the present invention it was however found that stationarity even though useful does not always provide a good indication whether background noise smoothing is desirable or not. Merely relying on a stationarity measure may again lead to situations where certain noise types are classified as stationary noise even though they exhibit properties that cannot adequately be modeled by the employed noise smoothing method.

A particular problem limiting all described methods arises from the fact that they are mere decoder methods. Due to this fact, they have conceptual problems to assess background noise properties with an accuracy which would be required if the noise smoothing operation should be controlled with a gradual resolution. This however, would be necessary for natural noise reproduction.

A general problem with all methods relying on a stationarity measure is that stationarity itself is a property indicative of how much statistical signal properties like energy or spectrum remains unchanged over time. For this reason stationarity measures are often calculated by comparing the statistical properties of a given frame, or sub-frame, with the properties of a preceding frame or sub-frame. However, only to a lesser degree provide stationarity measures an indication of the actual perceptual properties of the background signal. In particular, stationarity measures are not indicative of how noise-like a signal is, which however, according to studies by the inventors is an essential parameter for a good anti-swirling method.

Therefore, there is a demand for methods and arrangements for controlling background noise smoothing operation speech sessions in telecommunication systems.

SUMMARY

An object of the present invention is to enable an improved quality of a speech session in a telecommunication system.

A further object of the present invention is to enable improved control of smoothing of stationary background noise in a speech session in a telecommunication system.

These and other objects are achieved in accordance with the attached set of claims.

Basically, in a method of smoothing stationary background noise in a telecommunication speech session, initially receiving and decoding S10 a signal representative of a speech session, said signal comprising both a speech component and a background noise component. Further, providing S20 a noisiness measure for the signal, and adaptively S30 smoothing the background noise component based on the provided noisiness measure.

Advantages of the present invention comprise:

Improved quality of speech sessions in a telecommunication system.

An improved reconstruction signal quality of stationary background noise signals.

BRIEF DESCRIPTION OF THE DRAWINGS

The invention, together with further objects and advantages thereof, may best be understood by referring to the following description taken together with the accompanying drawings, in which.

ABBREVIATIONS

Figure 1:
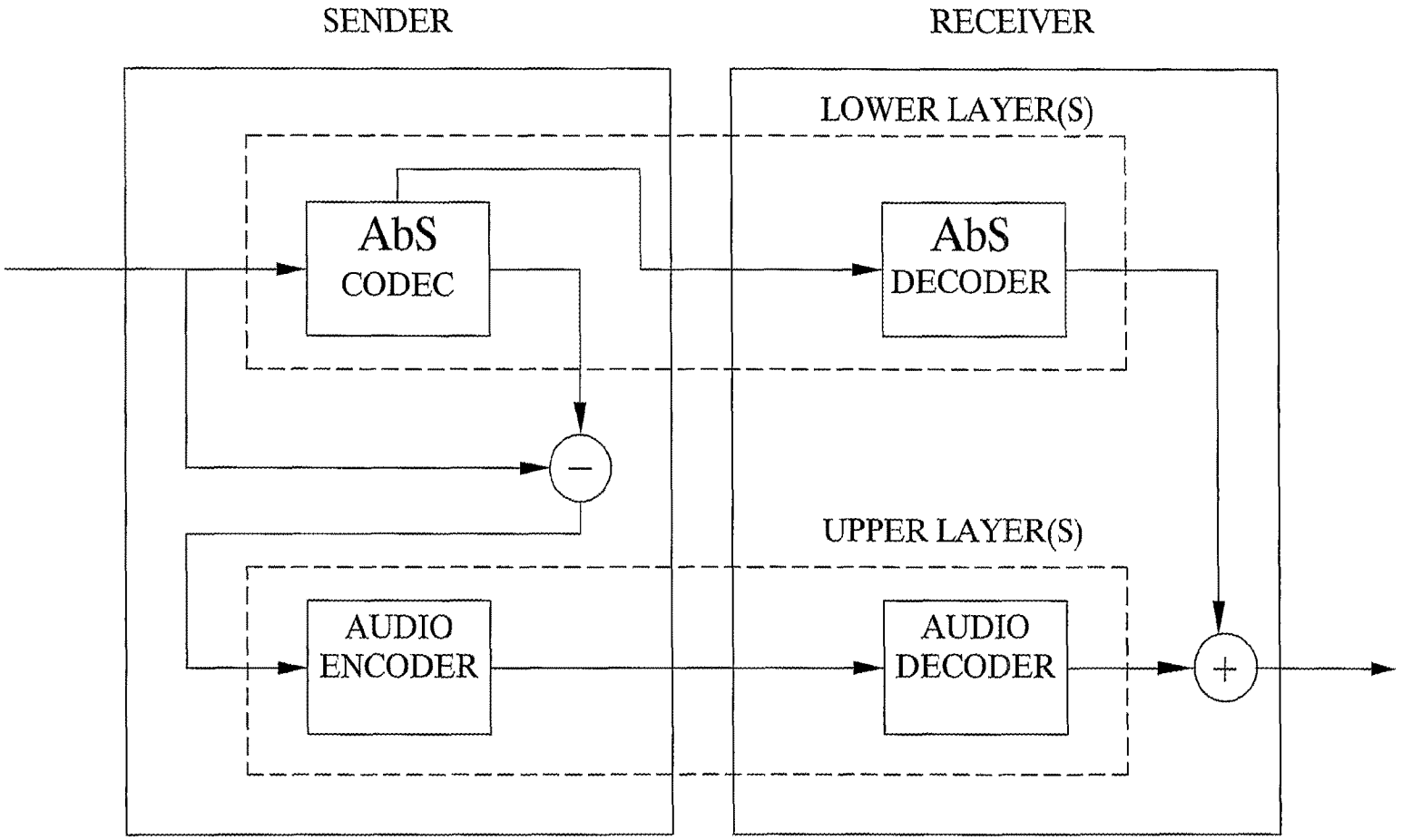
FIG. 1 is a schematic block diagram of a scalable speech and audio codec.

AbS Analysis by Synthesis
ADPCM Adaptive Differential PCM
AMR-WB Adaptive Multi Rate Wide Band
EVRC-WB Enhanced Variable Rate Wideband Codec
CELP Code Excited Linear Prediction
DXT Discontinuous Transmission
DSVD Digital Simultaneous Voice and Data
ISP Immittance Spectral Pair
ITU-T International Telecommunication Union
LPC Linear Predictive Coders
LSF Line Spectral Frequency
MPEG Moving Pictures Experts Group
PCM Pulse Code Modulation
SMV Selectable Mode Vocoder
VAD Voice Activity Detector
VOIP Voice Over Internet Protocol

DETAILED DESCRIPTION

The present invention will be described in the context of a wireless mobile speech session. However, it is equally applicable to a wired connection. Throughout the following description, the terms speech and voice will be used as being identical. Accordingly, a speech session indicates a communication of voice/speech between at least two terminals or nodes in a telecommunication network. A speech session is assumed to always include two components, namely a speech component and a background noise component. The speech component is the actual voiced communication of the session, which can be active (e.g. one person is speaking) or inactive (e.g. the person is silent between words or phrases). The background noise component is the ambient noise from the environment surrounding the speaking person. This noise can be more or less stationary in nature.

As mentioned before, one problem with speech sessions is how to improve the quality of the speech session in an environment including a stationary background noise, or any noise for that matter. According to known methods, there is frequently employed various methods of smoothing the background noise. However, there is a risk that a smoothing operation actually reduces the quality or "listenability" of the speech session by distorting the speech component, or making the remaining background noise even more disturbing.

In the course of investigations underlying the present invention, it was found that background noise smoothing is particularly useful only for certain background signals, such as car noise. For other background noise types such as babble, office, double taker, etc. background noise smoothing does not provide the same degree of quality improvements to the synthesized signal and may even make the background noise re-production unnatural. It was further found that "noisiness" is a suitable characterizing feature indicating if background noise smoothing can provide quality enhancements or not. It was also found that noisiness is a more adequate feature than stationarity, which has been used in prior art methods.

A main aim of the present invention is therefore to control the smoothing operation of stationary background noise gradually based on a noisiness measure or metric of the background signal. If during voice inactivity the background signal is found to be very noise-like, then a larger degree of smoothing is used. If the inactivity signal is less noise-like, then the degree of noise smoothing is reduced or no smoothing is carried out at all. The noisiness measure is preferably derived in the encoder and transmitted to the decoder where the control of the noise smoothing depends on it. However, it can also be derived in the decoder itself.

Figure 2:
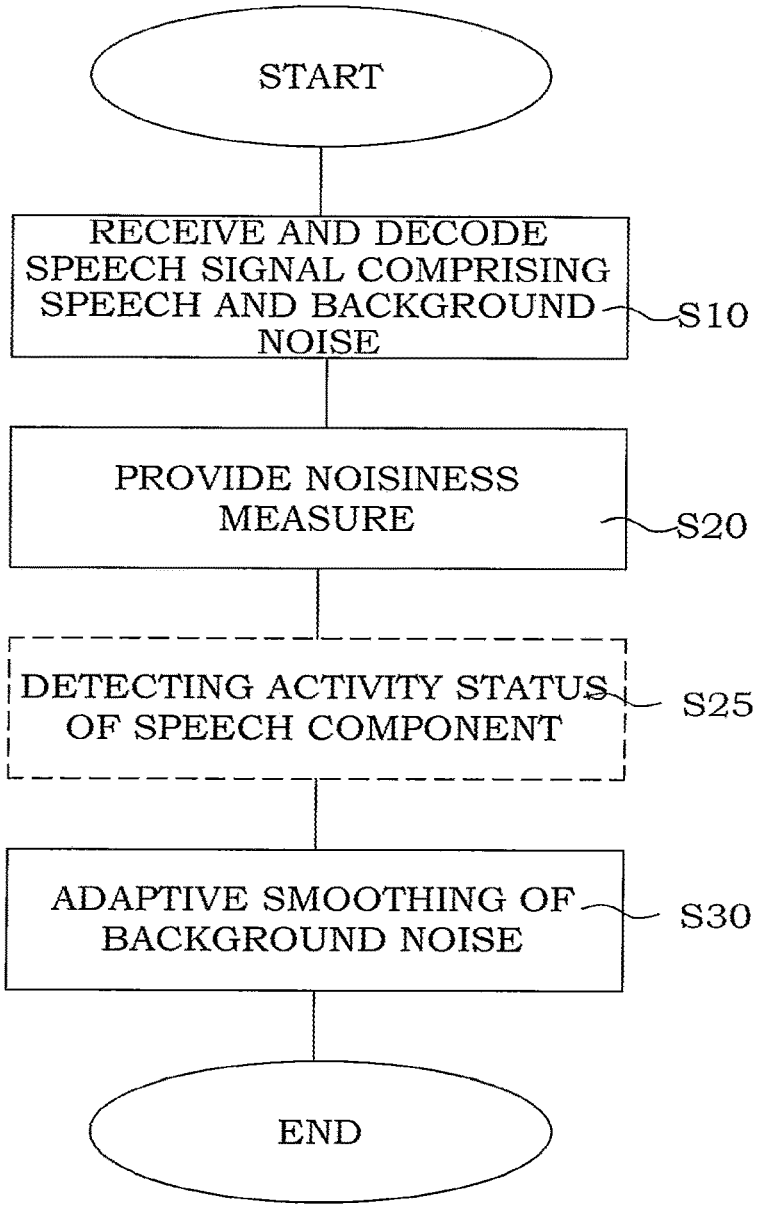
FIG. 2 is a flow chart illustrating an embodiment of a method of background noise smoothing according to the present invention.

Basically, with reference to FIG. 2, a general embodiment according to the present invention comprises a method of smoothing stationary background noise in a telecommunication speech session between at least two terminals in a telecommunication system. Initially, receiving and decoding S10 a signal representative of a speech session i.e. voiced exchange of information between at least two mobile users, the signal can be described as including both a speech component i.e. the actual voice, and a background noise component i.e. surrounding sounds. In order to smooth the background noise during periods of voice inactivity, a noisiness measure is determined for the speech session and provided S20 for the signal. The noisiness measure is a measure of how noisy the stationary background noise component is. Subsequently, the background noise component is adaptively smoothed S30 or modified based on the provided noisiness measure. Finally, the signal representative of the transmitted signal is synthesized with thus smoothed background noise component to enable a received signal with improved quality.

According to a further embodiment of the invention, the noisiness metric describes how noise-like the signal is or how much of a random component it contains. More specifically, the noisiness measure or metric can be defined and described in terms of the predictability of the signal, where signals with strong random components are poorly predictable while those with weaker random component are more predictable. Consequently, such a noisiness measure can be defined by means of the well-known LPC prediction gain $G_p$ of the signal, which is defined as:

$$G_p = \frac{\sigma_x^2}{\sigma_{e,p}^2} \tag{1}$$

Here $\sigma_x^2$ denotes the variance of the background (noise) signal and $\sigma_{e,p}^2$ denotes the variance of the LPC prediction error of this signal obtained with an LPC analysis of order p. Instead of variance, the prediction gain may also be defined by means of power or energy. It is also known that the prediction error variance $\sigma_{e,p}^2$ and the sequence of prediction error variances $\sigma_{e,k}^2$,k=1 . . . p−1 are readily obtained as by-products of the Levinson-Durbin algorithm, which is used for calculating the LPC parameters from the sequence of autocorrelation parameters of the background noise signal. Typically, the prediction gain is high for signals with weak random component while it is low for noise-like signals.

According to a preferred embodiment of the present invention a suitable similar noisiness metric is obtained by taking the ratio of the prediction gains of two LPC prediction filters with different orders p and q, where p>q:

$$\text{metric}(p, q) = \frac{G_p}{G_q} = \frac{\sigma_{e,q}^2}{\sigma_{e,p}^2} \tag{2}$$

This metric gives an indication how much the prediction gain increases when increasing the LPC filter order from q to p. It delivers a high value if the signal has low noisiness and a value close to 1 of the noisiness is high. Suitable choices are q=2 and p=16, though other values for the LPC orders are equally possible.

It is to be noted that preferably the above described noisiness metric or measure is determined or calculated at the encoder side, and subsequently transmitted to, and provided at the decoder side. However, it is equally possible (with only minor adaptation) to determine or calculate the noisiness metric based on the actual received signal at the decoder side.

One advantage of calculating the metric at the encoder side is that the computation can be based on un-quantized LPC parameters and hence potentially has the best possible resolution. In addition, the calculation of the metric requires no extra computational complexity since (as explained above) the required prediction error variances are readily obtained as a by-product of the LPC analysis, which typically is carried out in any case. Calculating the metric in the encoder requires that the metric subsequently it is quantized and that a coded representation of the quantized metric is transmitted to the decoder where it is used for controlling the background noise smoothing. The transmission of the noisiness parameter requires some bit rate of e.g. 5 bits per 20 ms frame and hence 250 bps, which may appear as a disadvantage. However, considering that the noisiness parameter is only needed during speech inactivity periods, it is possible, according to a specific embodiment, to skip this transmission during active speech and to merely transmit it during inactivity in which typically this bit rate may be available since the codec does not require the same bit rate as during active speech. Similarly, considering the special case of a speech codec that encodes unvoiced speech sounds and inactivity sounds with some particular lower-rate mode, it may also be possible to afford this extra bit rate without extra cost.

However, as already mentioned, it is possible to derive the noisiness measure at the decoder side based on the received and decoded LPC parameters. The well-known step-up/step-down procedures provide a way for calculating the sequence of prediction error variances from received LPC parameters, which in turn, as explained above, can be used to calculate the noisiness measure.

It should be pointed out that according to experimental results the noisiness measure of the present invention is very beneficial in combination with a specific background noise smoothing method with which it was combined in a study. However, in combination with other anti-swirling methods it may be beneficial to combine the measure with stationary measures, which are known from prior, art. One such measure with which the noisiness measure can be combined is an LPC parameter similarity metric. This metric evaluates the LPC parameters of two successive frames, e.g. by means of the Euclidian distance between the corresponding LPC parameter vectors such as e.g. LSF parameters. This metric leads to large values if successive LPC parameter vectors are very different and can hence be used as indication of the signal stationarity.

It is also to be noted that, besides the above mentioned conceptual difference between "noisiness" of the present invention and "stationarity" of prior art methods, there is at least one further important discriminating difference between these measures. Namely, calculating stationarity involves deriving at least a current parameter of a current frame and relating it to at least a previous parameter of some previous frame. Noisiness in contrast can be calculated as an instantaneous measure on a current frame without any knowledge of some earlier frame. The benefit is that memory for storing the state from a previous frame can be saved.

The following embodiments describe ways in which anti-swirling methods can be controlled based on the provided noisiness measure. It is assumed that the smoothing operation is controlled by means of control factors and that, without limiting the generality, a control factor equal to 1 means no smoothing operation while a factor of 0 means smoothing with the fullest possible degree.

According to a basic embodiment, the provided noisiness measure directly controls the degree of smoothing that is applied during the decoding of the background noise signal. It is assumed that the degree of smoothing is controlled by means of a parameter $\gamma$. Then it is for instance possible to map the noisiness metric from the above directly to $\gamma$ according to the following example expression $$\gamma=Q\{(\text{metric}-1)\cdot\mu\}+\nu \tag{3}$$

A suitable choice for $\mu$ is 0.5 and for p a value between 0.5 and 2. It is to be noted that $Q\{\cdot\}$ denotes a quantization operator that also performs a limitation of the number range such that the control factors do not exceed 1. It is further to be noted that preferably the coefficient $\mu$ is chosen depending on the spectral content of the input signal. In particular, if the codec is a wideband codec operating with 16 kHz sampling rate and the input signal has a wideband spectrum (0-7 kHz) then the metric will lead to relatively smaller values than in the case that the input signal has a narrowband spectrum (0-3400 Hz). In order to compensate for this effect, $\mu$ should be larger for wideband content than for narrow band content. A suitable choice is $\mu=2$ for wideband content and $\mu=0.5$ for narrowband content. However, also other values are possible depending on the specific situation. Accordingly, the degree of smoothing operation can be specifically calibrated by means of a parameter $\mu$, depending on if the signal comprises wideband content or narrowband content.

Figure 3:
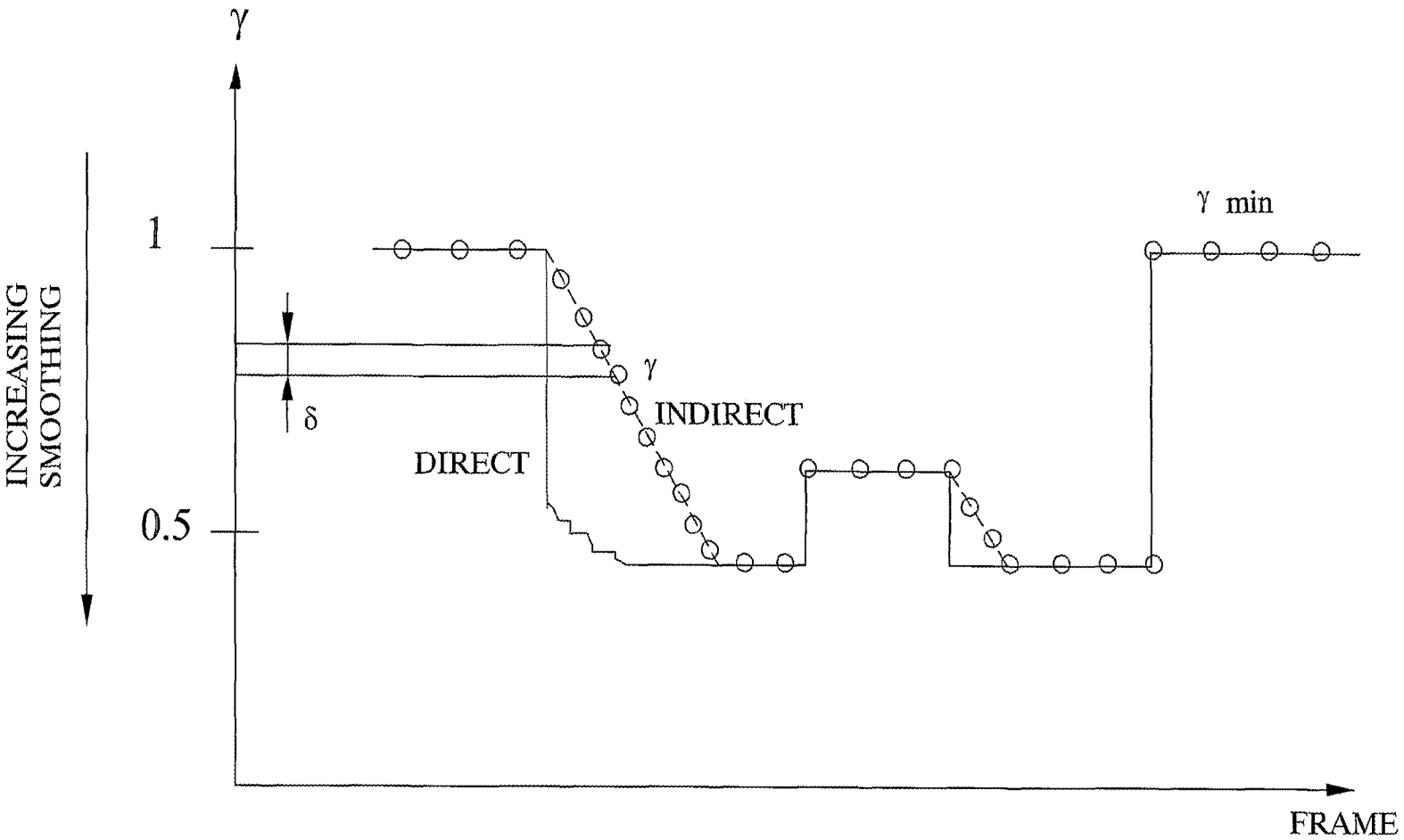
FIG. 3 is a schematic diagram illustrating a timing diagram of a method of indirect control of smoothing according to an embodiment of the present invention.

One important aspect affecting the quality of the reconstructed background noise signal is that the noisiness metric during inactivity periods may change quite rapidly. If the afore-mentioned noisiness metric is used to directly control the background noise smoothing, this may introduce undesirable signal fluctuations. According to a further preferred embodiment of the invention, with reference to FIG. 3, the noisiness measure is used for indirect control of the background noise smoothing rather than direct control. One possibility could be a smoothing of the noisiness measure for instance by means of low pass filtering. However, this might lead to situations that a stronger degree of smoothing could be applied than indicated by the metric, which in turn might affect the naturalness of the synthesized signal. Hence, the preferred principle is to avoid rapid increases of the degree of background noise smoothing and, on the other hand, allow quick changes when the noisiness metric suddenly indicates a lower degree of smoothing to be appropriate. The following description specifies one preferred way of steering the degree of background noise smoothing in order to achieve this behavior. It is assumed that the degree of smoothing is controlled by means of a parameter $\gamma$. Unlike the above-described direct control, the noisiness measure now steers an indirect control parameter $\gamma_{min}$ according to:

$$\gamma_{min}=Q\{(\text{metric}-1)\cdot\mu\}+\nu \tag{4}$$

Then the smoothing control parameter $\gamma$ is set to the maximum between $\gamma_{min}$ and the smoothing control parameter $\gamma'$ used previously (i.e. in the previous frame) reduced by some amount $\delta$:

$$\gamma=\max(\gamma_{min},\gamma'-\delta) \tag{5}$$

The effect of this operation is that $\gamma$ is steered step-wise towards $\gamma_{min}$ as long as $\gamma$ is still greater than $\gamma_{min}$ Otherwise it is identical to $\gamma_{min}$. A suitable choice for this step size $\delta$ is 0.05. The described operation is visualized in FIG. 3.

Investigations by the inventors have shown that the smoothing of the background noise in direct or indirect dependency on the provided noisiness measure can provide quality enhancements of the reconstructed background noise signal. It has also been found that it is important for the quality to make sure that the smoothing operation is avoided during active speech and that the degree of smoothing of the background noise does not change too frequently and too rapidly.

A related aspect is the voice activity detection (VAD) operation that controls if the background noise smoothing is enabled or not. Ideally, the VAD should detect the inactivity periods in between the active parts of the speech signal in which the background noise smoothing is enabled. However, in reality there is no such ideal VAD and it happens that parts of the active speech are declared inactive or that inactive parts are declared active speech. In order to provide a solution for the problem that active speech may be declared inactive it is common practice, e.g. in speech transmissions with discontinuous transmission (DTX) to add a so-called hangover period to the segments declared active. This is a means, which artificially extends the periods declared active. It decreases the likelihood that a frame is erroneously declared inactive. It has been found that a corresponding principle can also be applied with benefit in the context controlling the background noise smoothing operation.

Figure 6:
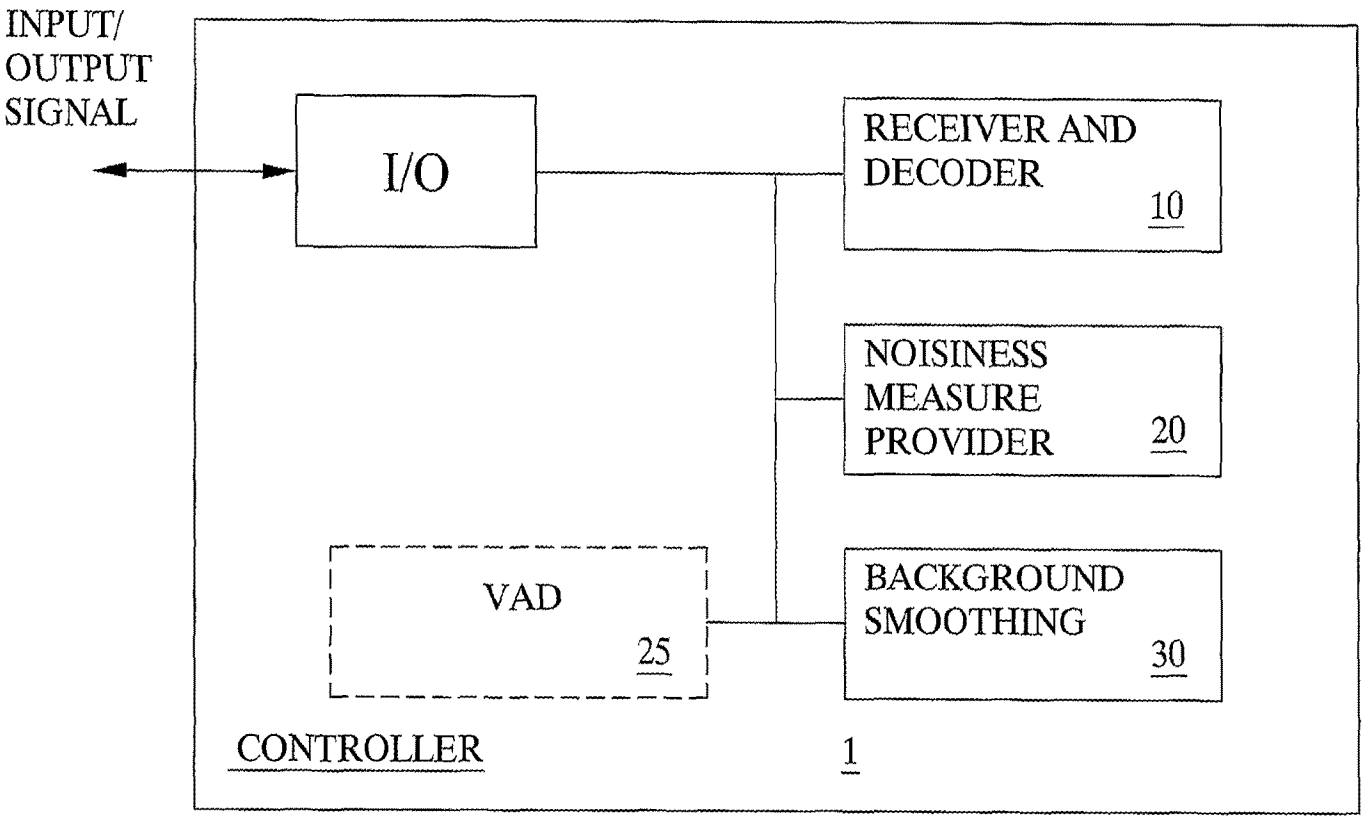
FIG. 6 is a block diagram illustrating an embodiment of a controller arrangement according to the present invention.

According to a preferred embodiment of the invention, with reference to FIG. 2 and FIG. 6, a further step S25 of detecting an activity status of the speech component is disclosed. Subsequently, the background noise smoothing operation is controlled and only initiated in response to a detected inactivity of the speech component. In addition a delay or hangover is used which means that background noise smoothing is only enabled a predetermined number of frames after which the VAD has started to declare frames inactive. A suitable choice, but not limiting, is e.g. to wait 5 frames (=100 ms) after the VAD has started to declare frames inactive before the noise smoothing is enabled. Regarding the problem that the VAD may sometimes declare non-speech frames active, it is found appropriate to turn off the background noise smoothing operation whenever the VAD declares the frame is active, regardless if this VAD decision is correct or not. In addition it is beneficial to immediately resume the background noise smoothing, i.e. without hangover, after spurious VAD activation. This is if the detected activity period is only short, for instance less or equal to 3 frames (=60 ms).

In order to improve the performance of the background noise smoothing further, it is found beneficial to gradually enable the background noise smoothing after the hangover period rather than turning it on too abruptly. In order to achieve such a gradual enabling a phase-in period is defined during which the smoothing operation is gradually steered from inactivated to fully enabled. Assuming the phase-in period to be K frames long and further assuming that the current frame is the n-th frame in this phase-in period, then the smoothing control parameter g* for that frame is obtained by interpolation between its original value γ and its value corresponding to deactivation of the smoothing operation ($\gamma_{inact}=1$)

$$g^* = 1 + \frac{(\gamma - 1)\cdot n}{K} \tag{6}$$

It is to be noted that it is beneficial to activate phase-in periods only after hangover periods, i.e. not after spurious VAD activation.

Figure 4:
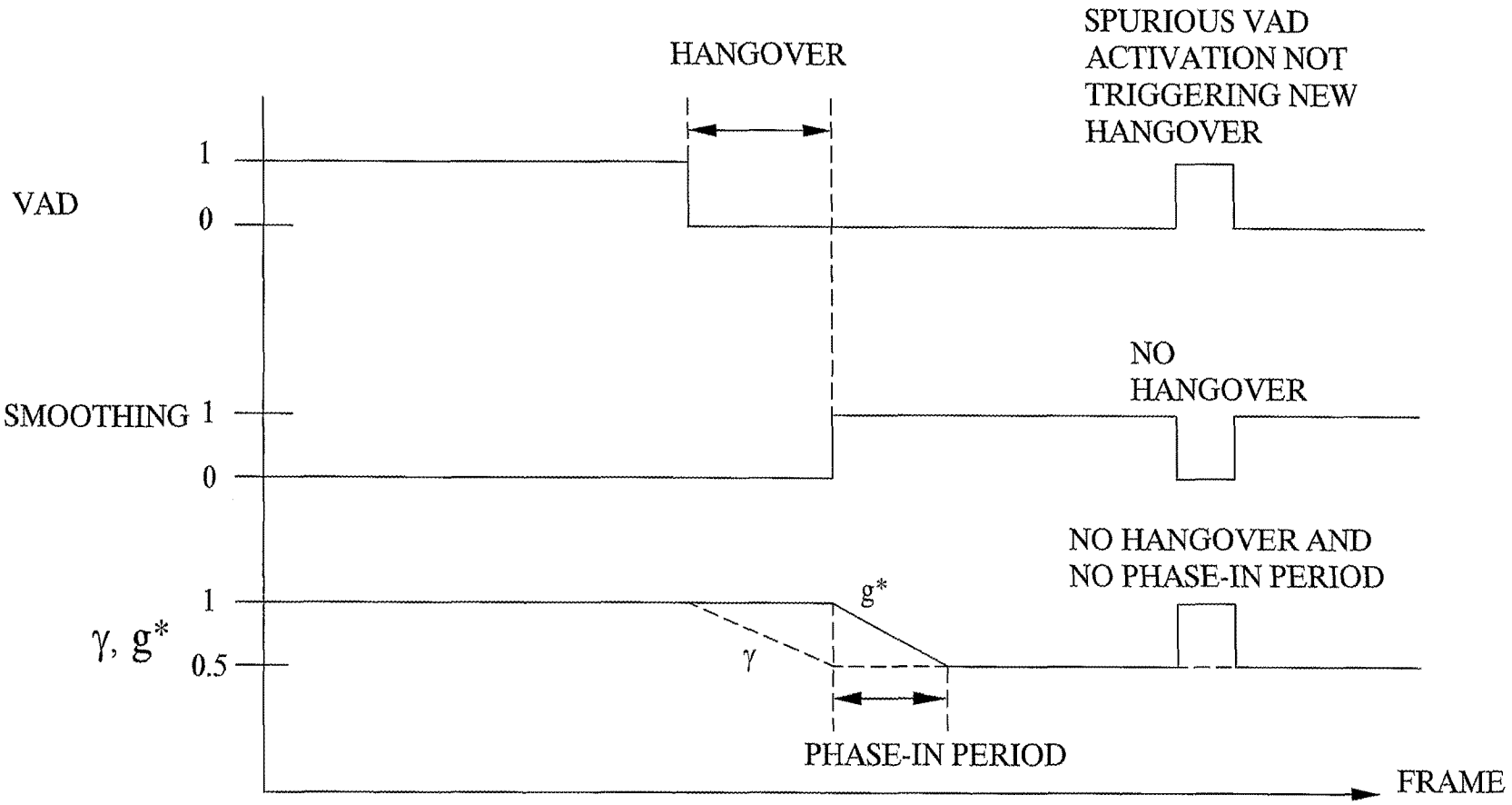
FIG. 4 is a schematic diagram illustrating a timing diagram of a VAD driven activation of background noise smoothing according to an embodiment of a method according to the present invention.

FIG. 4 illustrates an example timing diagram indicating how the smoothing control parameter g* depends on a VAD flag, added hangover and phase-in periods. In addition, it is shown that smoothing is only enabled if VAD is 0 and after the hangover period.

Figure 5:
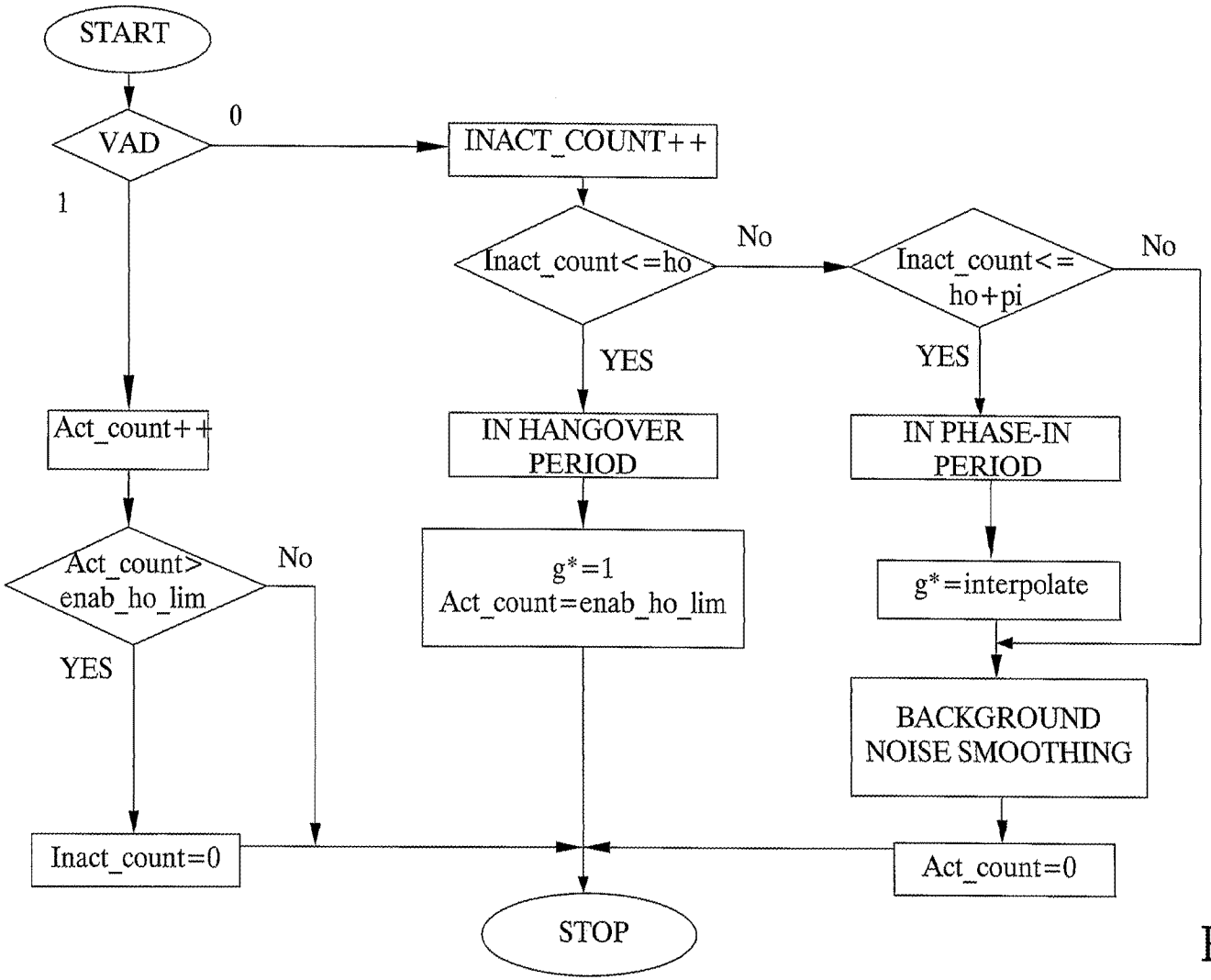
FIG. 5 is a flow chart illustrating an embodiment of an arrangement according to the present invention.

A further embodiment of a procedure implementing the described method with voice activity driven (VAD) activation of the background noise smoothing is shown in the flow chart of FIG. 5 and is explained in the following. The procedure is executed for each frame (or sub-frame) beginning with the start point. First, the VAD flag is checked and if it has a value equal to 1 the active speech path is carried out. Here, a counter for active speech frames (Act_count) is incremented. Then it is checked if the counter is above the spurious VAD activation limit (Act_count>enab_ho_lim) and if this is the case, the counter for inactive frames is reset (Inact_count=0), which in turn is a signal that a hangover period will be added during the next inactivity period. After that the procedure stops.

If however the VAD flag has a value equal to 0 indicating inactivity, then the inactive speech path is executed. Here, first the inactive frame counter (Inact_count) is incremented. Then it is checked if this counter is less or equal to the hangover limit (Inact_count<=ho) in which case the execution path for the hangover period is carried out. In that case, the noise smoothing control parameter g* is set to 1, which disables the smoothing. In addition, the active frame counter is initialized with the spurious VAD activation limit (Act_count=enab_ho_lim), which means that hangover periods are still not disabled in case of subsequent spurious VAD activation. After that the procedure stops. If the inactivity frame counter is larger than the hangover limit, then it is checked if the inactive frame counter is less or equal to the hangover limit plus the phase-in limit (Inact_count<=ho+pi). If this is the case, then the processing of the phase-in period is carried out which means that the noise smoothing control parameter is obtained by means of interpolation (g*=interpolate) as described above. Otherwise, the noise smoothing control parameter is left unmodified. After that, the background noise smoothing procedure is carried out with a degree according to the noise smoothing parameter. Subsequently, the active frame counter is reset (Act_count=0), which means that subsequently hangover periods are disabled after spurious VAD activations. After that the procedure stops.

Depending on the quality achieved with the noise smoothing procedure it may lead to quality enhancements not only during inactive speech but also during unvoiced speech which has a noise-like character. Hence, in this case the voice activity driven activation of the background noise smoothing may benefit from an extension that it is activated during not only inactive speech frames, but also unvoiced frames.

A preferred embodiment of the invention is obtained by combining the methods with indirect control of background noise smoothing and with voice activity driven activation of the background noise smoothing.

According to a further embodiment of the invention in connection with a scalable codec the degree of smoothing is generally reduced if the decoding is done with a higher rate layer. This is since higher rate speech coding usually has less swirling problems during background noise periods.

A particularly beneficial embodiment of the present invention can be combined with a smoothing operation in which a combination of LPC parameter smoothing (e.g. low pass filtering) and excitation signal modification. In short, the smoothing operation comprises receiving and decoding a signal representative of a speech session, the signal comprising both a speech component and a background noise component. Subsequently, determining LPC parameters and an excitation signal for the signal. Thereafter, modifying the determined excitation signal by reducing power and spectral fluctuations of the excitation signal to provide a smoothed output signal. Finally, synthesizing and outputting an output signal based on the determined LPC parameters and excitation signal. In combination with the controlling operation of the present invention a synthesized speech signal with improved quality is provided.

An arrangement according to the present invention will be described below with reference to FIGS. 6 and 7. Any well known general transmission/reception and/or encoding/decoding functionalities not concerned with the specific workings of the present invention are implicitly disclosed in the general input/output units I/O of in the FIGS. 6 and 7.

With reference to FIG. 6, a controller unit 1 for controlling the smoothing of stationary background noise components in telecommunication speech sessions is shown. The controller 1 is adapted for receiving and transmitting input/ output signals relating to speech sessions. Accordingly, the controller 1 comprises a general input/output I/O unit for handling incoming and outgoing signals. Further, the controller includes a receiver and decoder unit 10 adapted to receive and decode signals representative of speech sessions comprising both speech components and background noise components. Further, the unit 1 includes a unit 20 for providing a noisiness metric relating to the input signal. The noisiness unit 20 can, according to one embodiment, be adapted for actually determining a noisiness measure based on the received signal, or, according to a further embodiment, for receiving a nosiness measure from some other node in the telecommunication system, preferably from the node or user terminal in which the received signal originates. In addition, the controller 1 includes a background smoothing unit 30 that enables smoothing the reconstructed speech signal based on the noisiness measure from the noisiness measure unit 20.

According to a further embodiment, also with reference to FIG. 6, the controller arrangement 1 includes a speech activity detector or VAD 25 as indicated by the dotted box in the drawing. The VAD 25 operates to detect an activity status of the speech component of the signal, and to provide this as further input to enable improved smoothing in the smoothing unit 30.

Figure 7:
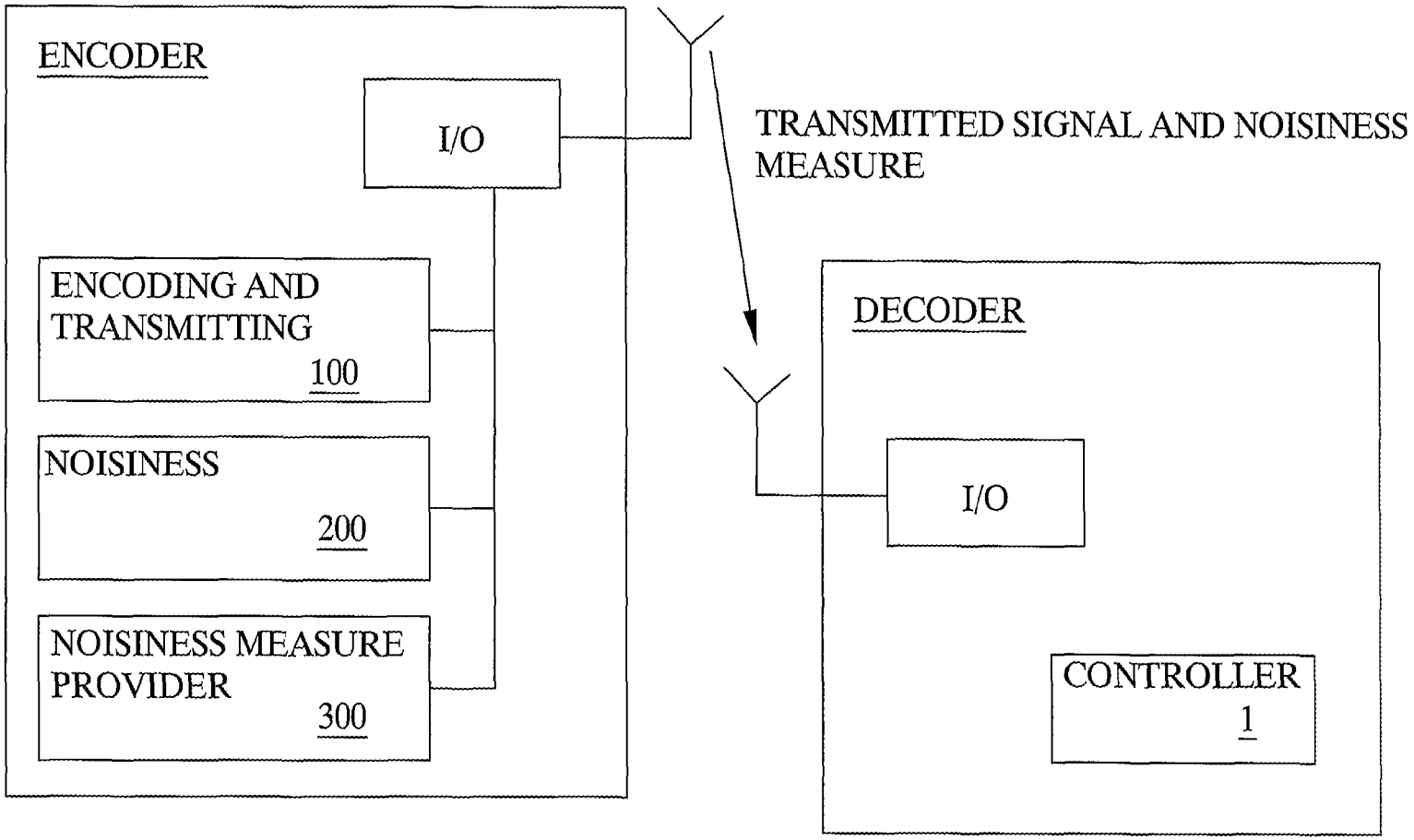
FIG. 7 is a block diagram illustrating embodiments of arrangements according to the present invention.

With reference to FIG. 7, the controller arrangement 1 preferably is integrated in a decoder unit in a telecommunication system. However, as described with reference to FIG. 6, the unit for providing a nosiness measure in the controller 1 can be adapted to merely receive a noisiness measure communicated from another node in the telecommunication system. Accordingly, an encoder arrangement in also disclosed in FIG. 7. The encoder includes a general input/output unit I/O for transmitting and receiving signals. This unit implicitly discloses all necessary known functionalities for enabling the encoder to function. One such functionality is specifically disclosed as an encoding and transmitting unit 100 for encoding and transmitting signals representative of a speech session. In addition, the encoder includes a unit 200 for determining a noisiness measure for the transmitted signals, and a unit 300 for communicating the determined noisiness measure to the noisiness provider unit 20 of the controller 1.

Advantages of the present invention include:

An improved background noise smoothing operation

Improved control of background noise smoothing

It will be understood by those skilled in the art that various modifications and changes may be made to the present invention without departure from the scope thereof, which is defined by the appended claims.

REFERENCES

[1] U.S. Pat. No. 5,632,004.
[2] U.S. Pat. No. 5,579,432.
[3] U.S. Pat. No. 5,487,087.
[4] U.S. Pat. No. 6,275,798 B1.
[5] 3GPP TS 26.090, AMR Speech Codec; Transcoding functions.
[6] EP 1096476.
[7] EP 1688920
[8] U.S. Pat. No. 5,953,697
[9] EP 665530 B1
[10] Tasaki et. al., Post noise smoother to improve low bit rate speech-coding performance, IEEE Workshop on speech coding, 1999
[11] Ehara et al., Noise Post-Processing Based on a Stationary Noise Generator, IEEE Workshop on speech coding, 2002.

The invention claimed is:

1. A method for coding of information for enhancing a background noise representation, the method comprising:

determining voice activity of an input speech signal;

determining a noisiness parameter for an inactive speech signal, wherein said noisiness parameter is based on a ratio between prediction error variances of two Linear Predictive Coder (LPC) prediction filters with different orders;

quantizing the noisiness parameter; and encoding the quantized noisiness parameter for transmission.

2. The method according to claim 1, wherein the ratio is $\sigma^2_{e,q}/\sigma^2_{e,p}$, where p>q and where $\sigma^2_e$ represents prediction error variance, and p and q represent orders of LPC analysis.

3. The method according to claim 1, wherein orders of said LPC prediction filters are $2^{nd}$ and $16^{th}$.

4. The method according to claim 1, wherein said noisiness parameter is adapted in response to a detected narrowband or wideband content of said input speech signal.

5. The method according to claim 1, wherein quantization of the noisiness parameter comprises normalizing the noisiness parameter with factor μ.

6. The method according to claim 5, wherein μ=2 for wideband content and μ=0.5 for narrowband content.

7. A speech encoder, comprising:

processing circuitry configured to determine voice activity of an input speech signal;

the processing circuitry configured to determine a noisiness parameter for an inactive speech signal, wherein said noisiness parameter is based on a ratio between prediction error variances of two Linear Predictive Coder (LPC) prediction filters with different orders;

the processing circuitry configured to quantize the noisiness parameter; and the processing circuitry configured to encode the speech signal for transmission.

8. The speech encoder according to claim 7, wherein said processing circuitry is further configured to calculate prediction error variances $\sigma^2_{e,q}$ and $\sigma^2_{e,p}$, where p and q represent orders of LPC analysis, and the ratio is $\sigma^2_{e,q}/\sigma^2_{e,p}$, where p>q.

9. The speech encoder according to claim 7, wherein said processing circuitry is further configured to adapt the noisiness measure in response to a detected narrowband or wideband content of said input speech signal.

10. The speech encoder according to claim 7, wherein said processing circuitry is further configured to normalize the noisiness parameter with factor μ.

11. An anti-swirling method for coded background noise, the method comprising:

receiving and decoding a coded speech signal;

obtaining a voice activity indication and a noisiness parameter for said speech signal, wherein said noisiness parameter is based on a ratio between prediction error variances of two Linear Predictive Coder (LPC) prediction filters with different orders; and adaptively smoothing background noise of said decoded speech signal based on said obtained noisiness parameter, wherein said smoothing operation is indirectly controlled by said noisiness parameter.

12. The method according to claim 11, wherein said smoothing operation is controlled by a further smoothing control parameter that is steered by said obtained noisiness parameter.

13. The method according to claim 11, wherein said noisiness parameter is received from an encoder, and decoded.

14. The method according to claim 11, wherein the smoothing control parameter is set to the maximum between the noisiness parameter and a smoothing control parameter used in a previous frame reduced by a step size δ.

15. The method according to claim 14, wherein the step size δ is 0.05.

16. The method according to claim 11, further comprising initiating said adaptive smoothing in response to said voice activity indication indicating inactive speech.

17. The method according to claim 16, comprising initiating said adaptive smoothing with a predetermined delay in response to a detected speech inactivity.

18. The method according to claim 17, wherein the predetermined delay is 5 frames.

19. The method according to claim 16, comprising resuming said background noise smoothing immediately in response to a detected speech inactivity after a spurious voice activity.

20. The method according to claim 19, wherein the spurious voice activity comprises detected activity period of less or equal to 3 frames.

21. The method according to claim 17, comprising gradually initiating said smoothing operation at the end of said delay.

22. The method according to claim 21, wherein the smoothing operation is gradually steered from inactivated to fully enabled during a phase-in period of K frames.

23. The method according to claim 22, wherein the smoothing control parameter for the phase-in period is modified as:

$$g^* = 1 + \frac{(\gamma - 1) \cdot n}{K},$$

where γ is the original value of the smoothing control parameter and the current frame is $n^{th}$ frame in the phase-in period.

24. The method according to claim 16, comprising terminating said adaptive smoothing immediately in response to detecting active speech.

25. A speech decoder, comprising:

processing circuitry configured to receive and decode a coded speech signal;

the processing circuitry further configured to obtain a voice activity indication and a noisiness parameter for said speech signal, said noisiness parameter being based on a ratio between prediction error variances of two Linear Predictive Coder (LPC) prediction filters with different orders; and the processing circuitry further configured to adaptively smoothe background noise of said decoded speech signal based on said obtained noisiness parameter, wherein said processing circuitry is adapted to be indirectly controlled by said noisiness parameter.

26. The speech decoder according to claim 25, wherein said processing circuitry is further configured to receive and decode said noisiness parameter.

27. The speech decoder according to claim 25, wherein the processing circuitry is further configured to initiate said adaptive smoothing in response to said speech signal having an inactive status.

28. The speech decoder according to claim 27, wherein said processing circuitry is further configured, in response to said speech signal having an inactive status, to initiate said adaptive smoothing with a predetermined delay.

29. The speech decoder according to claim 28, wherein said processing circuitry is further configured to gradually initiate said smoothing operation at the end of said delay.

30. The speech decoder according to claim 28, wherein said processing circuitry is further configured, in response to said speech signal having an active status, to terminate said adaptive smoothing immediately.

* * * * *